US009951542B2

(12) United States Patent
Giglio

(10) Patent No.: US 9,951,542 B2
(45) Date of Patent: Apr. 24, 2018

(54) CONVERTIBLE AWNING AND SHUTTER SYSTEM

(71) Applicant: Thomas Giglio, Potersville, NJ (US)

(72) Inventor: Thomas Giglio, Potersville, NJ (US)

( * ) Notice: Subject to any disclaimer, the term of this patent is extended or adjusted under 35 U.S.C. 154(b) by 0 days.

(21) Appl. No.: 15/169,798

(22) Filed: Jun. 1, 2016

(65) Prior Publication Data

US 2016/0273225 A1 Sep. 22, 2016

Related U.S. Application Data

(63) Continuation-in-part of application No. 14/716,655, filed on May 19, 2015, now abandoned.

(60) Provisional application No. 62/000,409, filed on May 19, 2014.

(51) Int. Cl.

| | |
|---|---|
| ***E06B 3/48*** | (2006.01) |
| ***E04H 15/58*** | (2006.01) |
| ***E04F 10/10*** | (2006.01) |
| ***E06B 9/06*** | (2006.01) |
| ***E04F 10/04*** | (2006.01) |
| *E06B 9/00* | (2006.01) |

(52) U.S. Cl.

CPC ..... *E04H 15/58* (2013.01); *E04F 10/04* (2013.01); *E04F 10/10* (2013.01); *E06B 9/0638* (2013.01); *E06B 9/0669* (2013.01); *E06B 2009/005* (2013.01)

(58) Field of Classification Search

CPC E04H 15/58; E04F 10/04; E04F 10/10; E05F 15/51; E05F 15/53; E05F 1/1091; E05D 15/262; E06B 9/0669; E06B 9/0638; E06B 2009/005; E06B 3/483

USPC ..... 160/62, 79

See application file for complete search history.

(56) References Cited

U.S. PATENT DOCUMENTS

| | | | | | |
|---|---|---|---|---|---|
| 2,733,484 | A * | 2/1956 | Jedlicka | E04F 10/10 | 49/343 |
| 2,774,416 | A * | 12/1956 | Angus | E04F 10/10 | 160/58.1 |
| 3,718,171 | A * | 2/1973 | Godwin | B64C 1/1415 | 160/188 |
| 3,800,484 | A * | 4/1974 | Marshall | E04B 1/3444 | 160/46 |
| 5,148,640 | A * | 9/1992 | Reilly, Sr. | E04B 7/00 | 135/88.1 |
| 6,079,762 | A * | 6/2000 | Strasser | B60J 5/0498 | 160/188 |
| 8,267,105 | B1 * | 9/2012 | Denmark, Jr. | E04H 15/08 | 135/117 |
| 8,511,738 | B2 * | 8/2013 | Brown | B60J 5/0473 | 296/146.12 |
| 8,714,229 | B2 * | 5/2014 | Crown | E06B 3/483 | 160/207 |

(Continued)

*Primary Examiner* — Katherine W Mitchell
*Assistant Examiner* — Abe Massad
(74) *Attorney, Agent, or Firm* — Smith Tempel Blaha LLC; Gregory Scott Smith

(57) ABSTRACT

The awning and shutter system serves as both a storm shutter when closed and a deck or patio awning when opened, and is designed with a counterweight making for effortless operation. Furthermore, some embodiments of the awning and shutter may feature a third position, substantially reducing the projection of the awning when in the opened position. This unique feature allows the system to sustain high wind conditions while maintaining interior view, shade and daylight.

19 Claims, 4 Drawing Sheets

(56) References Cited

U.S. PATENT DOCUMENTS

| | | | | |
|---|---|---|---|---|
| 9,303,443 | B2 * | 4/2016 | Lucas | E04F 10/10 |
| 2013/0008917 | A1 * | 1/2013 | Huang | E06B 3/483 220/810 |
| 2014/0182791 | A1 * | 7/2014 | Lee | G09F 11/12 160/34 |

* cited by examiner

CONVERTIBLE AWNING AND SHUTTER SYSTEM

BACKGROUND

A problem that exists in the market with regards to awnings and storm shutters, especially in high wind and storm prone locations such as the New Jersey shore, the Emerald Coast or any shoreline, are the corrosive affects of the salt air environment, the damaging affect of high winds, the force of rain as it is driven horizontally at 60 miles an hour for days at a time during a Northeaster or hurricane, and the impact that the sun's rays have upon the interior of homes and business with large expanses of glass.

There are products available that at least partly address a subset of the afore-mentioned problems, but there are no products or disclosures that address all of them in a single, effective embodiment. The most widely used products in this industry are the rolling storm shutter and the retractable awning. The rolling storm shutter provides storm and sun protection to interior spaces typically installed over glass openings and provides an additional thermal barrier as such. The retractable awning provides rain and shade protection to outside living spaces such as decks and patios. Both these products offer functions that are very desirable on both the residential and commercial markets. However, each of these products are installed directly over the door or window, so in a sense, they are mutually exclusive. You can have one or the other but not both.

Other storm protection systems include rigid and fabric panels that must be installed when the threat of adverse weather is eminent, and then removed later once the threat has passed. While these panels are substantially lower in cost, they are labor intensive to install, can be dangerous to install and require storage when not in use.

BRIEF SUMMARY

The various embodiments of the awning and shutter system presented herein serve as both a storm shutter when moved into a closed position or state, and a deck or patio awning when moved into an open or deployed position or state. Embodiments may be constructed using industry standard awning and marine fabrics, which are stretched across an aluminum frame, as a non-limiting example. Rigid materials can also be used in some embodiments. Further, embodiments may be available in both a one-piece and a multi-piece system. The various embodiments may operate using gas springs, regular springs, servomotors, manual, hand cranked or other mechanisms. Embodiments of the one-piece system may utilize one set of 'extension' gas springs, while embodiments of a two-piece system may utilize a set of 'extension' gas springs and a set of 'retraction' gas springs and multiple piece systems may use a set of extension and retraction springs for each component of the awning panel. As was previously stated, the awning and shutter embodiments may exist in either the closed (or down) position, providing storm and sun protection to interior space, or in the open (or up) position providing sun and rain protection to exterior living spaces. The two-piece system allows for a third position whereby while in the up position, the Awning/Shutter can be folded back to nearly half it's projection. This unique feature allows the system to sustain high wind conditions while maintaining interior view, shade and daylight.

In one particular embodiment, the awning panel may include a back panel and a front panel that are substantially rectangular in shape and are pivotally connected along a longitudinal edge when the panels are adjacent, although in some embodiments, the panels may be square or rectangular and connected along the longer edge or the shorter edge. The awning panel defines a front edge and a back edge and the back edge of the awning panel is pivotally associated with a structure, such as being connected directly to the structure or to a bracket that is connected to the structure.

A spring mechanism is used to move the awning panel from a closed position to an open position and may have sufficient force to hold the awning panel in any position. One end of the spring mechanism is pivotally associated with the structure (such as being connected to the structure or to a bracket that is attached to the structure) and the second end is pivotally attached to the awning panel such that when the spring mechanism is in a first position, the awning panel is in a closed state that is substantially parallel with the structure and when the spring mechanism is in a second position, the awning panel can be in an open state that can be approximately 45-90 degrees relative to the structure or at any angle relative to the structure.

Further, the front panel can be pivoted to extend from the back panel in the same plane or underneath the back panel when the awning panel is in the open state. Further, in some embodiments, can be pivoted above the awning panel.

Thus, the awning system can include one or more brackets that are attached to the structure and, the awning panel can be pivotally attached to an upper side of the bracket. The spring mechanism can be attached to a lower side of the bracket. It should be understood that the brackets may be in two pieces with each piece attached to the structure.

In some embodiments, the back panel and/or front panel may be constructed of a rigid frame with a material attached to the frame.

The awning system may include a second spring mechanism for moving the front panel relative to the back panel. One end of the second spring mechanism is pivotally attached to a side of the frame, or to a bracket on the side of the frame of the back panel and a second end of the second spring mechanism is pivotally attached to a side of the frame, or a bracket on the side of the frame of the front panel. Thus, the front panel can be moved between a position under the back panel to a position extending outward from the back panel and in the same plane or even over the back panel in some embodiments.

These and other embodiments, features and aspects are more fully described in the detailed description that follows.

DETAILED DESCRIPTION OF EXEMPLARY EMBODIMENTS

The various embodiments of the awning and shutter system were initially designed for waterfront residences and residences exposed to excessive amounts of sunlight. The embodiments effectively assist patio doors and windows in protection against the natural elements of driving rain, wind, salt, sand and damaging sun when closed, and provides beautiful patio or deck shade when opened. The various embodiment of the awning and shutter system also provide an additional thermal barrier to glass surfaces and may also minimize the need for interior window treatments, providing 99% filtering or shade protection from the sun's damaging rays to interior spaces. These features equate to substantial savings in energy costs.

In addition to providing storm protection, sun infiltration, shade and rain protection to outside living areas, and a thermal barrier, the various embodiments of the awning and shutter system is a perfect solution for screen porches, providing an extended shade footprint, protection of porch furnishings during inclement weather and privacy. The embodiments also operate as an ideal closure for clear openings such as concession stands, cabanas, and other applications were high security is not a factor.

Some embodiments of the awning shutter system are designed as a DIY (do-it-yourself) product. Such embodiments can be shipped, such as by UPS, unassembled or shipped assembled via common carrier. Assembly of such embodiments takes approximately one (1) hour and approximately 30 minutes to install. An instruction manual may be included with each embodiment of the awning and shutter system.

Figure 1:
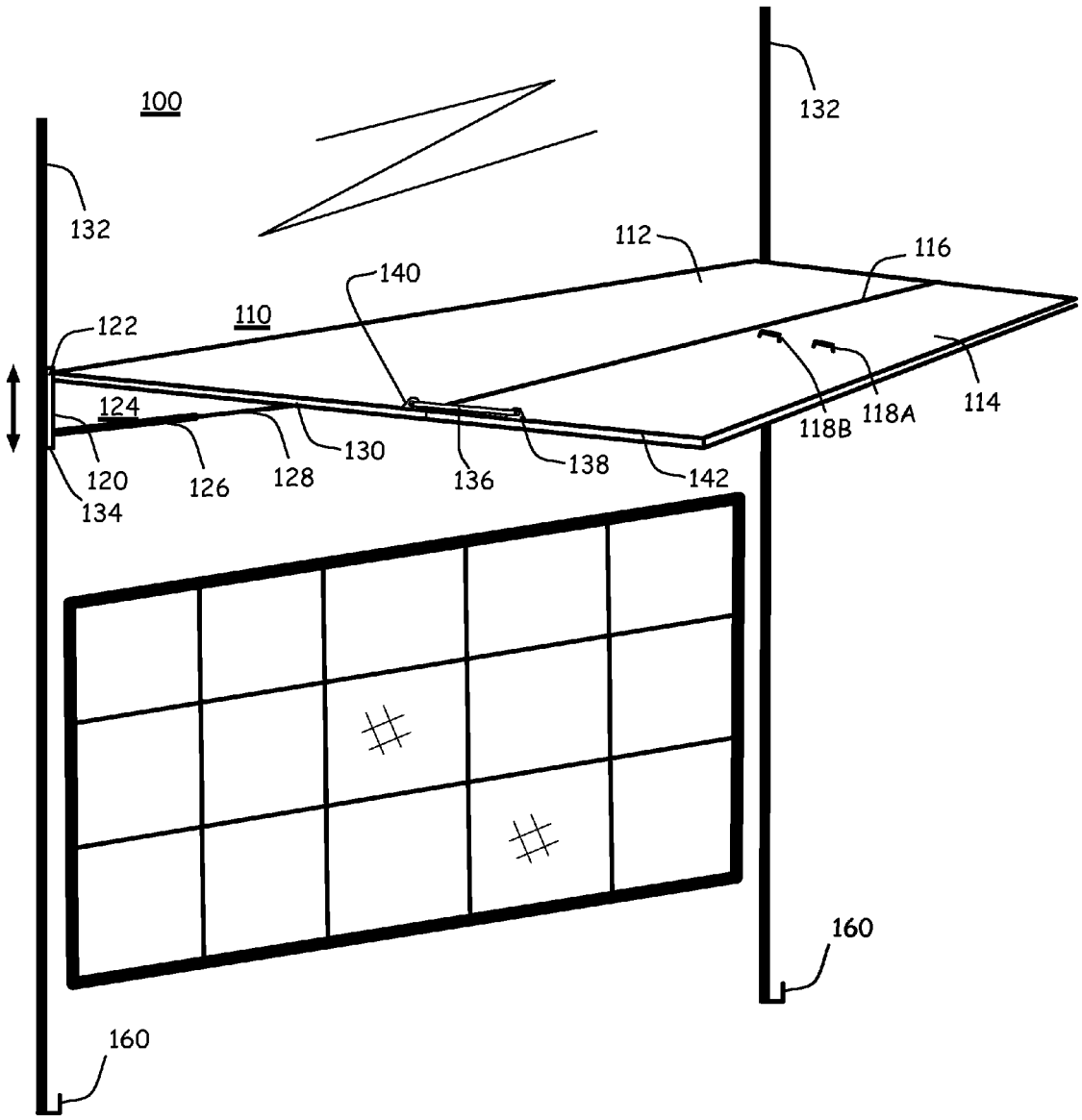
FIG. 1 is a conceptual diagram of an embodiment of the awning and shutter system in a fully deployed or open awning position.

FIG. 1 is a conceptual diagram of an embodiment of the awning and shutter system in a fully deployed or open awning position. The illustrated awning system 100 includes a two-piece awning panel 110 that includes a back panel 112 and a front panel 114 joined together along a hinged seam 116. The front panel 114 is illustrated as including two handles 118A and 118B. The back panel 112 is pivotally attached to a set of wall brackets 120 (only one is visible in FIG. 1 but two or more may be utilized) at pivot point 122. The awning panel may be connected to the brackets by a variety of techniques. A non-limiting example is utilizing a pin that extends through a left bracket and through a left side frame of the awning panel and a pin that extends through a right side bracket and through a right side from of the awning panel such that the awning panel can be pivoted downward and upward (i.e. such as 0 to 180 degrees relative to a support structure). In other embodiments, the back edge of the awning panel could be hinged to the structure and/or the brackets. Other techniques may also be employed as long as the connection mechanism enables the awning panel to pivot as described herein. It should also be appreciated that multi-directional pivoting techniques may also be employed. For instance, the awning panel could be pivoted to a fully closed position substantially parallel to a structure, and then a side of the awning panel could be pivotally connected to the structure and then pivoted to create a wall or divider. The brackets 120 are affixed to a surface, such as wall 132 using any of a variety of techniques known to those skilled in the art. The back edge of the awning panel may include a flap, flange or other structure that can be attached to the structure to prevent water or debris from passing through an area between the back edge of the panel and the structure.

An extension arm 124 is pivotally attached to a lower end of the bracket 120 at pivot point 134 (one may be attached to only one bracket or two or more of the brackets may include an extension arm 124) and attached to the back panel 112 at pivot point 130. It should be appreciated that the attachments at the pivot points could be any of a variety of connections including pins, rods, wheels, etc. In the illustrated embodiment, the extension arm includes a base 126 and an extension 128. The extension arm may be a spring, spring gas, hydraulic, pneumatic, or other type of extension arm and in the various embodiments it may be used only as support, as a biased force to help raise the panel 110 to an open position and/or as a biased force to help retract or slow down the retraction of the panel 110 into a closed position. Further, the extension arm 124 may also have sufficient force to hold the awning panel in any of the positions that it may pivot into from parallel to the structure (0 degrees) to any position up to 180 degrees but preferably at least 90 degrees relative to the structure.

A retraction spring 136 is illustrated as being pivotally attached to a side edge of the back panel 112 at bracket 140 and then pivotally attached to a side edge of the front panel 114 at bracket 138. Either or both of the attachments of the retraction sprint 136 at brackets 138 and 140 may be quick or easy release connections to allow the retraction spring 136 to be disconnected. In addition, either or both brackets 138 and 140 may be slideably attached to the edge 142 of the awning panel 110 such that as front panel 114 is raised or lowered (relative to back panel 112, one or both of the brackets can slide in a grove or other structure to allow panel to move, and/or the retraction spring may simply retract to allow for the movement as well. The retraction spring may be a spring, spring gas, hydraulic, pneumatic, or other type of arm and can be used only as support, as a biased force to help raise or lower the front panel 114 and/or as a biased force to help in the movement or slow down the movement of the back panel 114. Further, the retraction spring 124 may also have sufficient force to hold the front panel in any of the positions that it may pivot into from in the same plane as the back panel (0 degrees) to any position up to 180 degrees (parallel and underneath the back panel).

The hinge 116 between the back panel 112 and the front panel 114 may be configured to only allow the front panel 114 to swing in one direction relative to the back panel 112, such as up or down, or the hinge 116 may be configured to enable the front panel 114 to swing in two directions. In addition, the hinge may be bi-directional to allow the front panel to swing from parallel and below the back panel to parallel and above the back panel.

Figure 2:
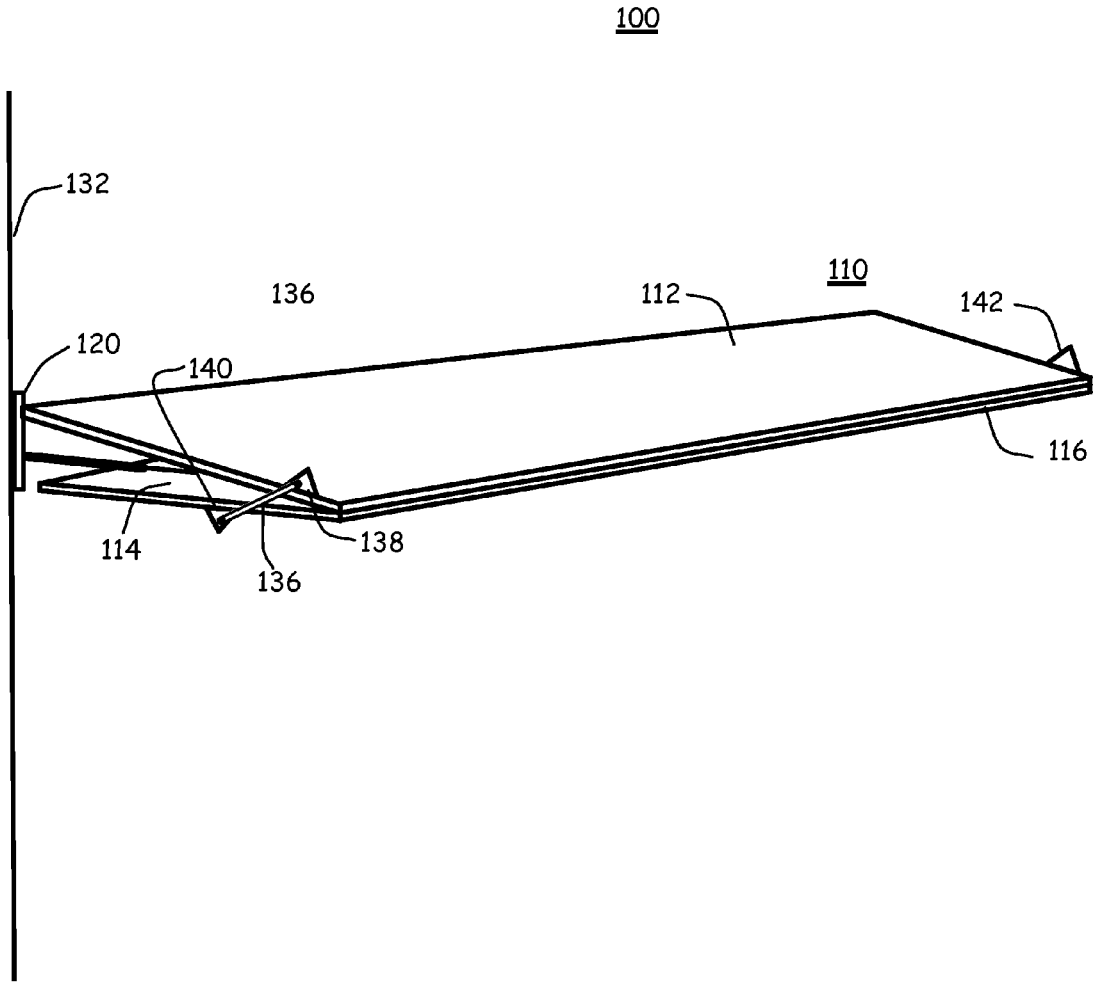
FIG. 2 is a conceptual diagram of an embodiment of the awning and shutter system in a partially deployed awning position.

FIG. 2 is a conceptual diagram of an embodiment of the awning and shutter system in a partially deployed awning position. In the illustrated embodiment, the awning panel 120 is shown as being folded under itself with the back panel 112 remaining substantially perpendicular to the wall 132, and the front panel 114 being folded under at hinge 116. The retraction spring 136 is shown as still connected between brackets 138 and 140. The retraction spring 136 may be configured such that it has sufficient strength to hold the front panel 114 in this position or, in other embodiments a lock or fastening mechanism may be used in addition or in lieu of the retraction spring 136.

The illustrated embodiment also show bracket 142 that can be used similar to bracket 138, to hold a second retraction spring (not shown).

Figure 3:
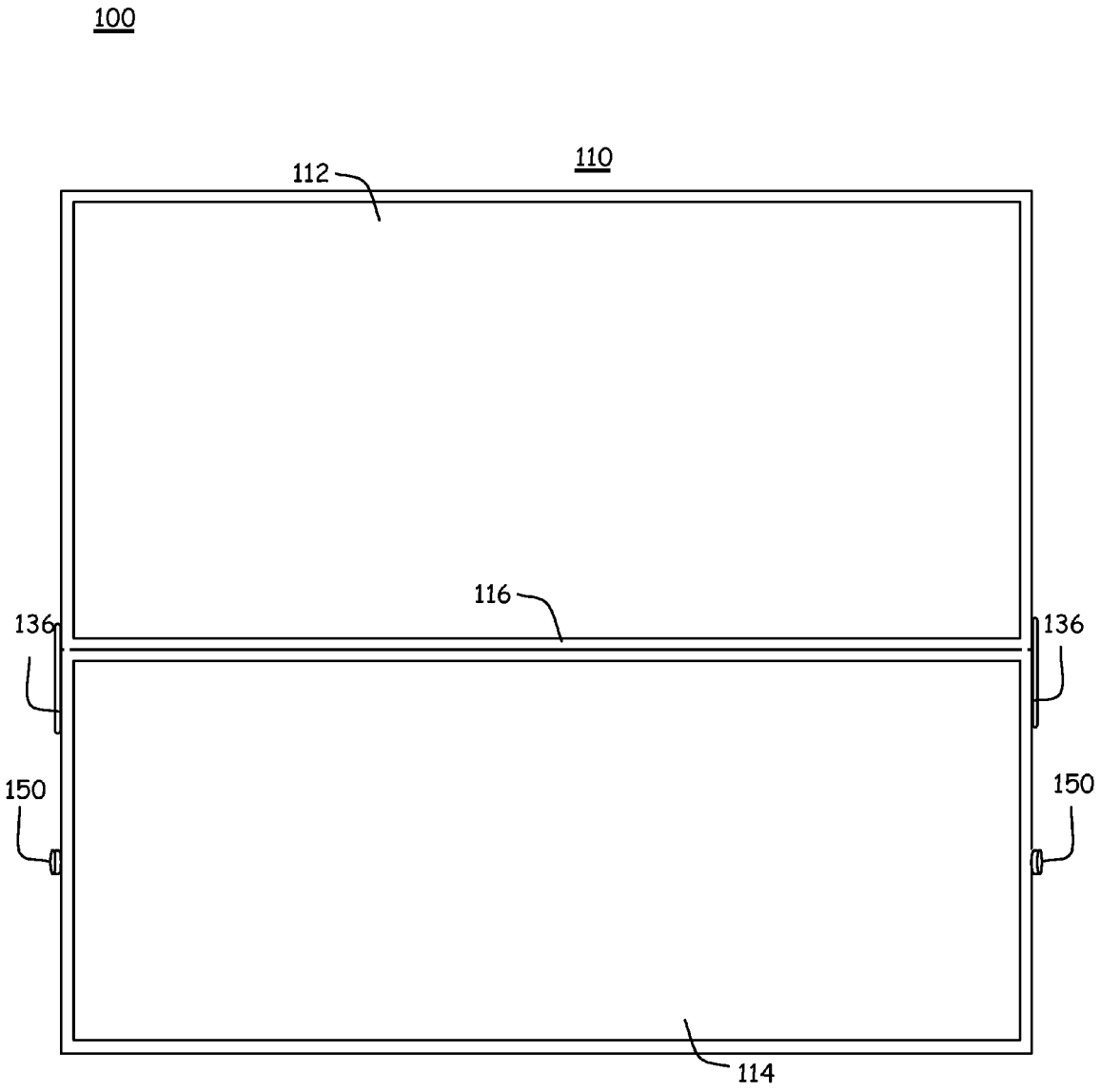
FIG. 3 is a conceptual diagram of an embodiment of the awning and shutter system in a fully closed shutter position.

FIG. 3 is a conceptual diagram of an embodiment of the awning and shutter system in a fully closed shutter position. In the illustrated embodiment, the awning panel 110 is full closed with the back panel 112 and the front panel 114 in the same plane, and typically parallel with a wall or opening behind it. In the illustrated embodiment, connectors 150 are illustrated on opposing sides of the front panel 114. These connectors 150 may be utilized to secure the awning panel into a closed position.

Figure 4:
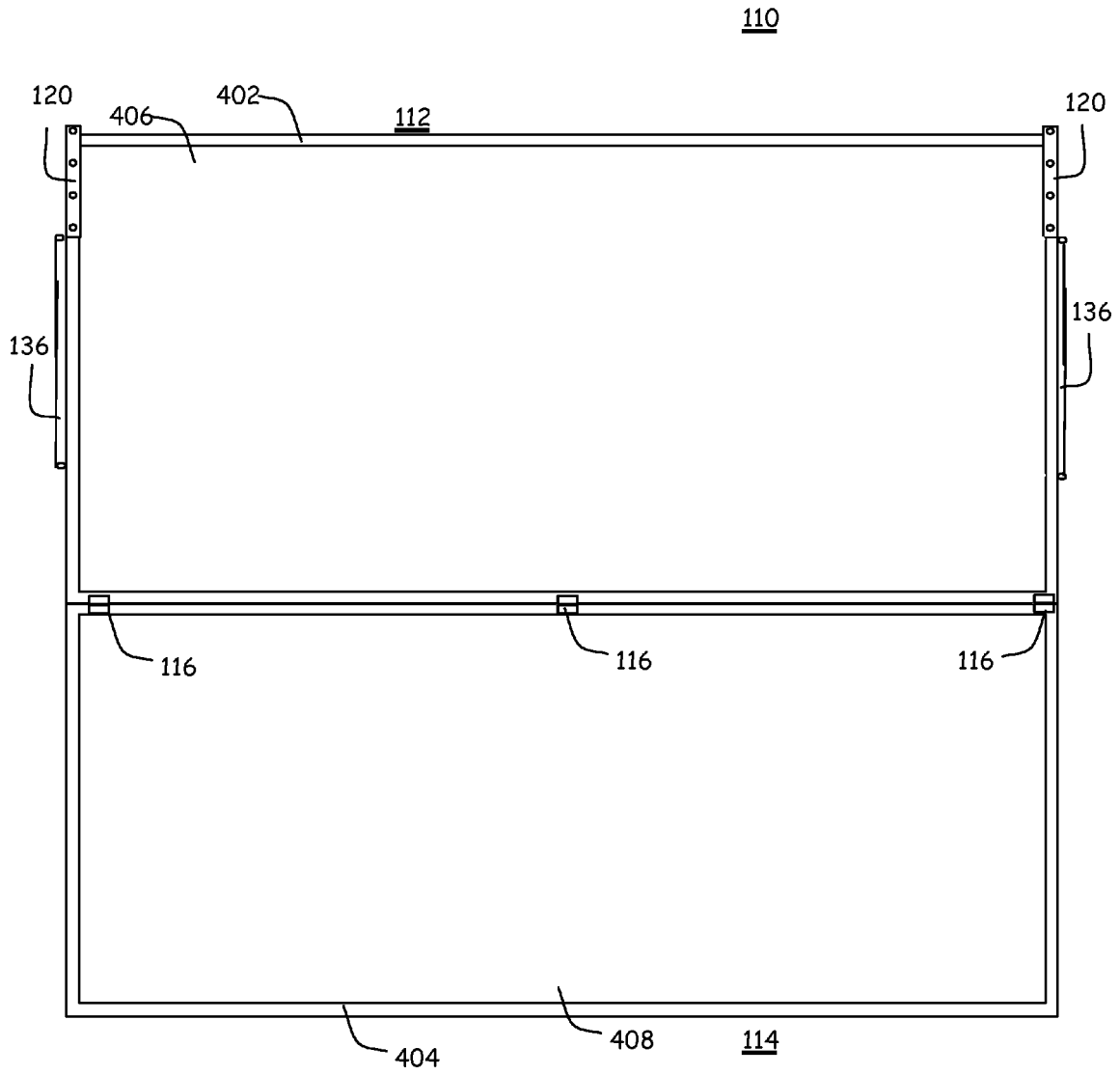
FIG. 4 is a conceptual diagram of the back or underside view of the embodiment of FIG. 3.

FIG. 4 is a conceptual diagram of the back or underside view of the embodiment of FIG. 3. In the illustrated embodiment, it is shown that the dimensions of the awning panel 110 can vary but in the illustrated embodiment, the height can be up to 10 feet and the width up to 14 feet, although it is understood that these dimensions may be increased or decreased in various embodiments. The back panel 112 is shown as including a frame 402 and the front panel 114 includes a frame 404. As presented in more detail under the construction heading, a skin fabricated from cloth, rigid, plastic, vinyl, fabric, aluminum, wood, composite or other material 406 can be attached to the back panel frame 402 and another skin 408 can be attached to the front panel frame 404. Thus, the back panel frame 402 and the front panel frame 404 support a skin affixed at or proximate to the perimeter. The back panel frame 402 and the front panel frame 404 can be constructed of a structural material such as aluminum, steel, wood, PVC, rigid plastic or other suitable material. The back panel frame 402 and front panel frame 404 are shown as being joined together with three hinges 116. Although the illustrated embodiment includes 3 hinges, it will be appreciated that any number of hinges of any size could be utilized. As a non-limiting example, a single piano style hinge could extend over substantially the entire joint between the back panel frame 402 and the front panel frame 404.

Construction

Various embodiments of the awning and shutter system may be constructed of a lightweight and rigid frame with industrial fabric. For instance, in some embodiments, the frame may be constructed of 1'×2' aluminum pipes or tubes with industry standard awning or marine fabric stretched across and affixed, similar in appearance to an artist's canvas but much heavier in construction. The tubing may be have a cross-section that is round, square, rectangular, triangular as well as a variety of other shapes. The tubes may be constructed from a lightweight material and the hollowed area of the tube may vary in diameter depending on the various needs of the embodiments. Further, the tubes may be augmented by the use of a rigid surface material, which may operate to provide additional rigidity and support or, a more flexible tube can be utilized and rigidity introduced through the use of the rigid surface material. Some embodiments may also use a solid rod, angle iron, angle aluminum, etc. Further, in some embodiments, the rigid surface material may be utilized as the sole source of rigidity and even in some embodiments eliminate the frame all together. The various embodiments may exist in many shapes and sizes but typical embodiments are designed to be approximately 1-3 feet wider than the opening or covered area and 0.5 to 1.5 feet higher than the opening or covered area. For instance, some embodiments are designed to be 2 feet wider than the opening (meaning one foot on each side of the opening) and one foot higher than the opening. However, it will be appreciated than different embodiments may be sized according to the specific application. When fabric is used, the fabric may be affixed to the frame using an industry standard pocket and spline system around the entire perimeter. In other embodiments, the fabric may be snapped over the frame, elastic may be used to hold the fabric to the frame, as well as a variety of other techniques including, but not limited to, rivets, clamps, slide insert locks, tubing similar to a screened window, etc.

In some embodiments, the awning shutter system includes an aluminum bracket that is affixed to the upper right and left corners of the frame. As a non-limiting example, the aluminum bracket may be approximately 1½" and 12" in length and affixed to the upper right and left corners of the frame using a 5/16 bolt secured to the bracket then penetrating into corners of the aluminum frame. Four #10 2" stainless steel screws may be used to attach the bracket to the structure as a non-limiting example. Also, in some embodiments a ball joint is attached to the bracket. The ball joint accepts an extension gas spring. It should be appreciated that although most embodiments are described as utilizing a gas spring, other embodiments may utilize a regular spring, a hydraulic plunger, adjustable arms, motorized lift arms, or other mechanisms to help lift and hold the awning and shutter in position. Further, in some embodiments, legs or stands may also be pivotally or hingedly attached to the frame such that when the frame is moved into an open position, the legs or stands may be pivoted into a position to provide additional support. The legs may also be telescoping legs that can be adjusted to accommodate different opening positions. In addition, a support element may be attached to the top of the frame at various positions from the front towards the rear and then angled to an attachment position on the structure to which the awning and shutter is attached. For instance, when the awning and shutter is moved to the open position, the support mechanisms can be pivoted from a position of being flat against the structure to one of a plurality of positions along the frame and then attached to the frame using a variety of techniques, such as pins or hooks as non-limiting examples. Further, the support legs may be removably attached to the awning and shutter system such that the legs can be attached when the awning is in the open position and then removed prior to closing the awning and shutter. Further, the legs can be pivotally attached to the frame such that in one configuration, the legs may operate to support the awning and shutter from the ground, in another position they can be pivoted upward and attached to the mounting surface at an angle to provide upper support or even pivoted below the awning and shutter and mounted to the back surface of the structure at an angle to provide underneath support.

In the two-piece embodiments of the awning and shutter system, the two panels are hinged together using elements such as butt or piano hinges. The lower panel, once the system is opened, can be folded under the upper section, reducing the projection by nearly half. This may be accomplished in a variety of manners and one non-limiting example is through the use of two 'retraction' gas springs, attached to steel-plate mounting brackets that are affixed to the upper and lower panels at each side. Ball joints may be affixed to the brackets and then the gas spring may then be snapped over the ball joints. Magnetic latches may be positioned at either side near the bottom to hold the awning and shutter in the down position. In addition and for added security, a ¼" steel pin can be slid through a bracket and into the side of the frame at approximately 2' from the bottom.

In some embodiments, the frame can be constructed out of plastic, wood, PVC, composite or any of a variety of materials. Further, the wall or cover can be constructed from cloth, canvas, plastic, PVC, wood, tin, aluminum, screen, fiberglass, or any of a variety of materials. The system can be fabricated in a variety of shapes and sizes. For instance, as non-limiting examples, the awning shutter system can be round, oval, rectangular, square, trapezoidal, semicircular, animated animal shapes, as well as any of a variety of shapes. The various embodiments of the awning and shutter system can be a solid unit, a bi-fold unit or even a multifold unit. Trim can be attached to and hang from the ends for decorative looks or additional sun/wind blocking. Further, panels may also be attached to the embodiments to create an enclosure, such as vinyl panels, opaque panels, see through panels, mosquito netting, screens, etc. The cover can be opaque, translucent or transparent. A gutter system may be included to channel water to one end or the other.

The various embodiments can be mounted on a house, trailer, an RV, a camper, a building, a balcony, shed a wall or any other structure. In addition, some embodiments may even be free standing or stands/anchors may be used. Some embodiments may be small for animal shelters or larger for homes. One embodiment may be associated or affixed to a grill to hide the grill, or other object, when not in use, and then shelter the user when the grill or object is in use. Some embodiments may include fold down flanges on the side, or drop down flaps. Some embodiments may include attachable curtains, nettings, enclosures, etc. Some embodiments may include pre-wiring for attachment of lighting, heaters or fans. Some embodiments may include hooks or other means for hanging plants, pictures, ornaments, fans, lighting, heaters, etc. Some embodiments may be paintable. Some embodiments may include interchangeable covers for different looks. Some embodiments may include protective coverings.

In some embodiments, the device may operate as a door, such as a garage door or a cabana door in one position, and then as an awning in another position. In other embodiments, the device may actually operate as a window and all or a portion of the cover part may be glass, Plexiglass or some other transparent material, LEXAN or similar material. In such embodiments, the device may include a seal for providing a substantially airtight, bug tight and watertight seal. In other embodiments, the window embodiment may be mounted in a recess thereby further facilitating the seal.

In some embodiments the device may be permanently, or pseudo permanently mounted to a structure, such as using nails, bolts, screws, glue, etc. Yet in other embodiments, the device may be removeably attached to the structure using pins, cogs, etc. so that the device can be easily removed for repair, storage, painting, staining, changing the cover, etc.

In another embodiment, two or more devices can be connected in tandem to provide flexibility in the size of the awning. In such an embodiment, the devices would be side by side. In the closed position, they would rest vertically. One or more of the side by side panels may then be moved to an open position and, the panels may be moved to different states of open. For a larger awning, multiple devices can be lifted and secured in position. In such an embodiment, the portions of the units adjacent to each other may include flaps to help provide water movement away from the joint between them. Similarly, a tongue and groove structure may also be employed to meet this need. For a smaller awning fewer devices can be lifted and secured. Or if two sides of a patio are to be covered but the middle remain open, in a three or more tandem embodiment, the end units may be lifted leaving the center unit(s) in a closed position.

In another embodiment, two units can be secured back to back to create a two-sided wall. One side can be lifted and secured to create a covered space with back or, both sides can be lifted to create a larger covered space. For instance, this embodiment would be well suited for outdoor trade shows, markets etc.

The various embodiments, in addition to lifting from a closed position to an open position, may also include a variety of settings between fully opened and fully closed. For instance, such an embodiment may allow a full 180 degrees of displacement or, can be secured at any one of a plurality of settings between 0 degrees and 180 degrees.

In addition, various embodiments, in addition to movement between the closed and open position, may also provide a tilting feature so that the awning can be lifted to a desired angle, and then tilted to further control the shade casting. In such an embodiment, the device can be mounted on an axel and then a crank can be used to tilt the awning. In a tandem embodiment, the various units may be able to be tilted in unison or individually.

Yet in other embodiments, the awning and shutter may be mounted with a rail system to allow the back portion of the awning and shutter system to be raised or lowered along vertical rails or slide left or right along horizontal rails. Further, various embodiments may include back hinges as well as side hinges. In such embodiments, the awning and shutter can be moved from a closed to an open position by pivoting the awning along the back hinge or, the awning and shutter system can be moved from closed to open position by pivoting along a side hinges. Thus, the operative hinge may include sliding pins to enable either the back hinge or the side hinge. Both hinges may be engaged in the closed position to provide additional securement of the awning and shutter in the closed position and then, the pins for the desired hinging structure can be left in position while the other pins removed or slide to disable the other hinging system. For a two-piece system, a left and right hinge or a side and middle hinge may be used to create French door or conference room door like openings.

In some embodiments, the awning panel and/or brackets can be attached in such a manner that the awning panel and/or awning panel and brackets can be moved upwards relative to the wall approximately 1-3 inches. Further, such embodiments may utilize a lower bracket attached to the structure proximate to the floor, or attached to the floor proximate to the structure. In operation, this feature, which can be incorporated into any of the various embodiments, allows the awning panel to be moved towards the closed state and then, the awning panel can be lifted upwards and slid behind lower brackets 160 to securely hold the panel in position.

In some embodiments, portions of the covering may be attached with a zipper, loop and hook, snaps, etc. such that an opening can be created in the awning and shutter. Further, such portions can be mounted over a transparent or translucent area of the awning and shutter system to allow a windowing effect when removed or a closed effect when replaced. Portions of the awning and shutter system may also include blinds like mechanisms to allow openings to be partially created.

In the description and claims of the present application, each of the verbs, "comprise", "include" and "have", and conjugates thereof, are used to indicate that the object or objects of the verb are not necessarily a complete listing of members, components, elements, or parts of the subject or subjects of the verb.

The present invention has been described using detailed descriptions of embodiments thereof that are provided by way of example and are not intended to limit the scope of the invention. The described embodiments comprise different features, not all of which are required in all embodiments of the invention. Some embodiments of the present invention utilize only some of the features or possible combinations of the features. Variations of embodiments of the present invention that are described and embodiments of the present invention comprising different combinations of features noted in the described embodiments will occur to persons of the art.

It will be appreciated by persons skilled in the art that the present invention is not limited by what has been particularly shown and described herein above. Rather the scope of the invention is defined by the claims that follow.

What is claimed is:

1. An awning system comprising:

an awning panel comprising a back panel and a front panel that are substantially rectangular;

a first pivoting mechanism that pivotally connects the back panel to the front panel along a longitudinal edge of the front panel when the panels are adjacent;

the awning panel having a front edge and a back edge and wherein the back edge of the awning panel is pivotally connected to a structure by a second pivoting mechanism;

a first spring mechanism having a first end and a second end, wherein the first end is pivotally connected to the structure and the second end is pivotally connected to the awning panel such that when the first spring mechanism is in a first position, the awning panel is in a closed state in which the awning panel is substantially parallel with the structure and when the first spring mechanism is in a second position, the awning panel is in an open state in which the awning panel is oriented approximately 45-90 degrees relative to the structure; and a left side second spring mechanism and a right side second spring mechanism with a first end of the left side second spring mechanism being pivotally attached to a left side of a frame of the back panel and a second end of the left side second spring mechanism being pivotally attached to a left side of a frame of the front panel, and with a first end of the right side second spring mechanism being pivotally attached to a right side of the frame of the back panel and a second end of the right side second spring mechanism being pivotally attached to a right side of the frame of the front panel, such that the front panel can be moved between a folded position and an extended position; wherein in the folded position, the front panel is located under the back panel and a plane defined by the front panel is substantially parallel to a plane defined by the back panel, and in the extended position, the front panel extends outwardly from the back panel such that the plane of the front panel and the plane of the back panel are coplanar; wherein the front panel is configured to be movable to the extended position in both the open state and the closed state.

2. The awning system of claim 1, wherein the wherein the front panel can be pivoted underneath the back panel when the awning panel is in the open state.

3. The awning system of claim 1, further comprising a plurality of brackets attached to the structure, each bracket having an upper end and a lower end such that when attached vertically to the structure, the back edge of the awning panel is pivotally connected to the structure by pivotally connecting the back edge of the awning panel to the upper end of each bracket.

4. The awning system of claim 1, wherein the frame of the back panel comprises a rigid frame with a material attached to the rigid frame.

5. The awning system of claim 4, wherein the frame of the back panel defines the back edge of the awning panel, and wherein the awning panel is pivotally connected to the structure by being pivotally connected to a left bracket on the left side of the frame of the back panel proximal to the back edge of the awning panel and to a right bracket on the right side of the frame of the back panel proximal to the back edge, wherein the left bracket and the right bracket are attached to the structure.

6. The awning system of claim 5, wherein the first end of the first spring mechanism is pivotally connected with the structure by being pivotally connected to the left or right bracket.

7. The awning system of claim 5, wherein the first spring mechanism includes a left side first spring mechanism, the first end of the left side first spring mechanism is pivotally connected with the structure by being pivotally attached to the left bracket and the second end of the left side first spring mechanism is pivotally attached to the awning panel at the left side of the back panel.

8. The awning system of claim 7, wherein the first spring mechanism includes a right side first spring mechanism, the first end of the right side first spring mechanism is pivotally connected to the structure by being pivotally attached to the right bracket and the second end of the right side first spring mechanism is pivotally attached to the awning panel at the right side of the back panel.

9. The awning system of claim 8, wherein the right side and left side first spring mechanisms are gas springs that can provide a force to assist in moving the awning panel from the closed state to the open state.

10. The awning system of claim 8, wherein the right side and left side first spring mechanisms are gas springs that can provide a force to assist in moving the awning panel from the closed state to the open state and the force is sufficient to hold the awning panel in the open state.

11. The awning system of claim 8, wherein the frame of the front panel comprises a rigid frame with a material attached to the rigid frame.

12. The awning system of claim 11, wherein the left side second spring mechanism and the right side second spring mechanism provide a force that is sufficient to hold the front panel in the extended position.

13. The awning system of claim 11, wherein the left side second spring mechanism and the right side second spring mechanism provide a force that is sufficient to hold the front panel in the folded position.

14. The awning system of claim 11, further comprising one or more lower brackets, wherein the left side and right side brackets are configured such that the awning panel can be slid upwards a sufficient distance to allow the front edge of the awning panel to slide behind a lower bracket.

15. The awning system of claim 11, wherein the material attached to the frame of the back panel and front panel is a fabric.

16. The awning system of claim 15, wherein the material is removeably attached to the frames.

17. The awning system of claim 11, wherein the first pivoting mechanism comprises one or more hinges and each hinge is attached to the frame of the back panel and the frame of the front panel.

18. An awning system comprising:

an awning panel comprising a back panel and a front panel that are substantially rectangular, wherein the back panel includes a hollow tube frame covered with a fabric and the front panel includes a hollow tube frame covered with a fabric, the awning panel being movable between a closed state in which the awning panel is substantially parallel to a structure and an open state in which the awning panel is oriented approximately 45 to 90 degrees relative to the structure;

one or more hinges, with each hinge attached to the frame of the back panel and the frame of the front panel such that the back panel and the front panels are adjacent along a longitudinal edge and wherein the front panel can be moved between a folded position and an extended position wherein in the folded position, the front panel is located under the back panel and a plane defined by the front panel is substantially parallel to a plane defined by the back panel, and in the extended position, the front panel extends outwardly from the back panel such that the plane of the front panel and the plane of the back panel are coplanar; wherein the front panel is configured to be movable to the extended position in both the open state and the closed state;

the awning panel having a front edge and a back edge and wherein the back edge of the awning panel is pivotally attached to one or more brackets, wherein the one or more brackets include a top and a bottom and can be attached to the structure;

a first spring mechanism having a first end and a second end, wherein the first end is pivotally attached proximal to the bottom of the bracket and the second end is pivotally attached to the frame of the back panel such that the first spring mechanism allows the awning panel to pivot relative to the structure;

a left side second spring mechanism and a right side second spring mechanism with a first end of the left side second spring mechanism being pivotally attached to a left side of the frame of the back panel and a second end of the left side second spring mechanism being pivotally attached to a left side of the frame of the front panel, and with a first end of the right side second spring mechanism being pivotally attached to a right side of the frame of the back panel and a second end of the right side second spring mechanism being pivotally attached to a right side of the frame of the front panel.

19. An awning system comprising:

an awning panel comprising a back panel and a front panel that are substantially rectangular, wherein the back panel includes a hollow tube frame covered with a fabric and the front panel includes a hollow tube frame covered with a fabric, the awning panel being movable between a closed state in which the awning panel is substantially parallel to a structure and an open state in which the awning panel is oriented approximately 45 to 90 degrees relative to the structure;

one or more hinges, with each hinge attached to the frame of the back panel and the frame of the front panel such that the back panel and the front panels are adjacent along a longitudinal edge and wherein the front panel can be moved between a folded position and an extended position; wherein in the folded position, the front panel is located under the back panel and a plane defined by the front panel is substantially parallel to a plane defined by the back panel, and in the extended position, the front panel extends outwardly from the back panel such that the plane of the front panel and the plane of the back panel are coplanar; wherein the front panel is configured to be movable to the extended position in both the open state and the closed state;

the awning panel having a front edge and a back edge and wherein the back edge of the awning panel is pivotally attached to one or more brackets, wherein the one or more brackets include a top and a bottom and can be attached to the structure;

one or more first spring mechanisms with each first spring mechanism having a first end and a second end, wherein the first end is pivotally attached proximal to the bottom of one of the one or more brackets and the second end is pivotally attached to the frame of the back panel such that the first spring mechanism allows the awning panel to pivot relative to the structure and the one or more first spring mechanisms exert a force sufficient to hold the awning panel in one of a plurality of positions; and a second spring mechanism with a first end attached to the back panel and a second end attached to the front panel.

* * * * *